United States Patent [19]

Just

[11] Patent Number: 4,603,628

[45] Date of Patent: Aug. 5, 1986

[54] SELF-INKING STAMP WITH ADJUSTABLE PRINTING MEMBERS

[76] Inventor: Walter Just, Franz Resl-Strasse 3, A-4600 Wels, Austria

[21] Appl. No.: 748,761

[22] Filed: Jun. 26, 1985

[30] Foreign Application Priority Data

Jul. 26, 1984 [AT] Austria ..... 2413/84

[51] Int. Cl.[4] ..... B41J 1/00

[52] U.S. Cl. ..... 101/105

[58] Field of Search ..... 101/105, 104, 334

[56] References Cited

U.S. PATENT DOCUMENTS

| | | | |
|---|---|---|---|
| 338,153 | 3/1886 | Hill | 101/105 |
| 384,026 | 6/1888 | Dietz | 101/105 |
| 392,229 | 11/1888 | Sawyer et al. | 101/105 |
| 401,519 | 4/1889 | Scotford | 101/105 |

FOREIGN PATENT DOCUMENTS

| | | | |
|---|---|---|---|
| 375584 | 1/1984 | Austria | 101/105 |
| 2020162 | 11/1971 | Fed. Rep. of Germany | 101/334 |

*Primary Examiner*—Clifford D. Crowder
*Attorney, Agent, or Firm*—Kurt Kelman

[57] ABSTRACT

A self-inking stamping device of the type which inverts as it travels between inking and printing positions upon movement of an actuating member. A stamping insert is pivoted on the actuating member and comprises a frame which is provided with a fixed printing plate and a stamping belt unit movably mounted in the frame of the stamping insert and comprising a plurality of juxtaposed parallel endless stamping belts, which are longitudinally adjustable relative to each other and carry type protruding through an aperture of the printing plate. The stamping belt unit is adjustable by a screw mechanism in a direction which is normal to the plane of the printing plate. In order to ensure that the inking and printing operations will always be performed under the same conditions, regardless of the thickness of the printing plate, the pivot of the stamping insert is held without backlash in the stamping belt unit, the frame of the stamping insert is provided with slots, which are normal to the plane of the printing plate, and the pivot extends through said slots so that said pivot is adjustable relative to the frame along said slots in unison with the stamping belt unit.

3 Claims, 4 Drawing Figures

FIG. 3
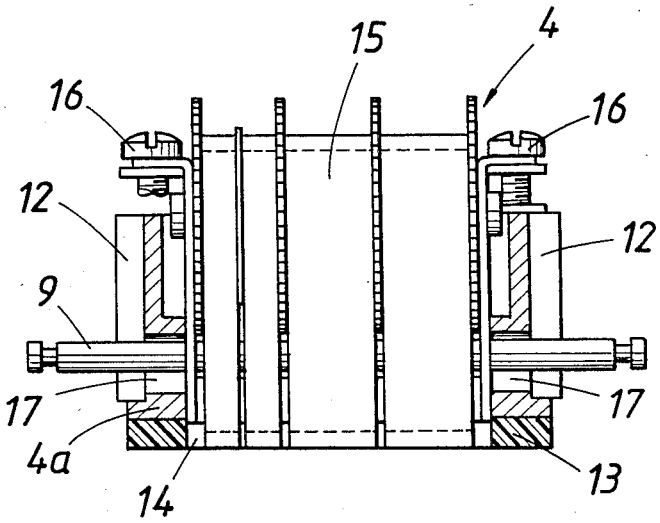
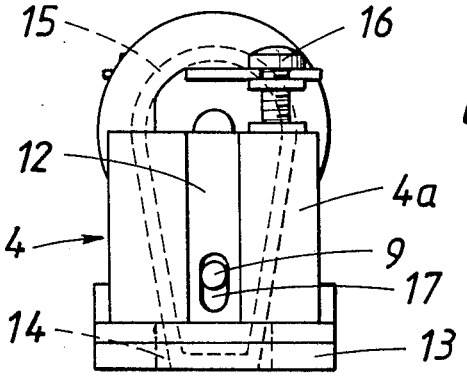
FIG. 4

SELF-INKING STAMP WITH ADJUSTABLE PRINTING MEMBERS

BACKGROUND OF THE INVENTION

1. Field of the Invention

This invention relates to a self-inking stamping device for performing an inking upstroke, comprising a base part, which is provided with a bearing rim for engaging a surface to be marked and accommodates an ink pad, also comprising a stamping insert, which is accommodated in the base part and reciprocable between the ink pad and the bearing rim and arranged to be inverted during its reciprocation, and an actuating member, which has two end legs in sliding contact with opposite end faces of the base part and displaceable toward the bearing rim against spring force, which actuating member is formed with slots, which extend transversely to the direction in which the actuating member is displaceable and receive a pivot for the stamping insert, which pivot extends through cam slots formed in the end walls of the base part, wherein said stamping insert comprises a frame, which is provided with a printing plate and which is provided at opposite ends with two vertical tracks, each of which receives a pin provided on the adjacent end wall of the base part, and a stamping unit is movably mounted in the frame of the stamping insert and adjustable by screw means in a direction which is normal to the plane of the printing plate and adapted to protrude through an aperture formed in the printing plate.

2. Description of the Prior Art

Self-inking stamping devices of that type are known, e.g., from Austrian Patent Specification Nos. 286,325 and 375,584, which describe such devices in which the stamping insert consists only of a stamping belt unit. In other known self-inking stamping devices the stamping insert consists only of a carrier for the printing plate, which is provided with an invariable script or character image. Other self-inking stamping devices known in practice comprise a stamping insert which includes a stamping belt unit and a printing plate. In said devices, the belts of the stamping belt unit carry the numeral and letter type which is required for a date mark and the printing plate is provided, e.g., the name of a business enterprise and the word "Received on" and/or "Time limit on". Because the stamping belt unit protrudes through the printing plate, the permanent inscription provided by the type on the printing plate can be combined with the changing date mark provided by the stamping belts. But the plates are mostly made of rubber and often vary in thickness. If the stamping device is to produce a uniform imprint, the type on the stamping belts must be arranged in the same plane as the surface of the type on the printing plate. For this purpose the stamping belt unit is mounted in the frame of the stamping insert so as to be adjustable by screw means in a direction which is normal to the plane of the printing plate. The printing plate is adhesively joined to the associated backing plate of the frame and the stamping belt unit is then adjusted to a position in which the surfaces of the type on the stamping belts and the type on the printing plate lie in one plane.

In the prior art, the pivot of the entire stamping insert is held without backlash in the frame of that insert. For this reason an application of printing plates differing in thickness and the corresponding re-adjustment of the stamping belt unit in the frame will necessarily change the distance from the pivotal axis of the stamping insert to the plane that is defined by the surface of the type on the stamping belts and the printing plate. But the pivot of the stamping insert is guided and/or movably mounted in the cam slots formed in the end walls of the base part and particularly in the slots formed in the legs of the actuating member and extending transversely to the direction in which the actuating member is displaceable, and the axis of the pivot determines the position of the entire stamping insert so that a change of the distance from the surface of the type to that pivotal axis will result in irregularities and inequalities regarding the pressure under which the type is applied to the ink pad and/or the surface to be marked.

SUMMARY OF THE INVENTION

For this reason it is an object of the invention to eliminate these disadvantages and so to improve the self-inking stamping device described first hereinbefore that the inking and printing operations can always be performed under the same conditions regardless of the thickness of the printing plate which is used.

This object is accomplished in accordance with the invention in that the pivot of the stamping insert is held without backlash in the stamping belt unit, the frame of the stamping insert is provided with slots, which are normal to the plane of the printing plate, and the pivot extends through said slots, so that the pivot is adjustable relative to said frame along said slots in unison with the stamping belt unit.

Because the pivot of the stamping insert is held without backlash in the set of stamping belts rather than in the frame of the stamping insert, the distance from the axis of said pivot to the surface of the type on the belts will remain constant. When the stamping belt unit is relatively adjusted to move the surface of the type on the belts to a position in the plane of the surface of the type on the printing plate, the distance from the pivotal axis of the type carrier to the surface of the type will always be the same regardless of whether the printing plate is thick or much thinner and the thickness of the printing plate will no longer have an influence on the inking and stamping operations. The slots formed in the frame of the stamping insert permit an adjustment of the pivot in a direction which is normal to the plane of the printing plate in unison with the stamping belt unit.

BRIEF DESCRIPTION OF THE DRAWING

FIG. 3 is a vertical sectional view showing the stamping insert alone as viewed on a plane through its pivotal axis.

FIG. 4 is a corresponding side elevation.

DETAILED DESCRIPTION OF THE DRAWING

Figure 1:
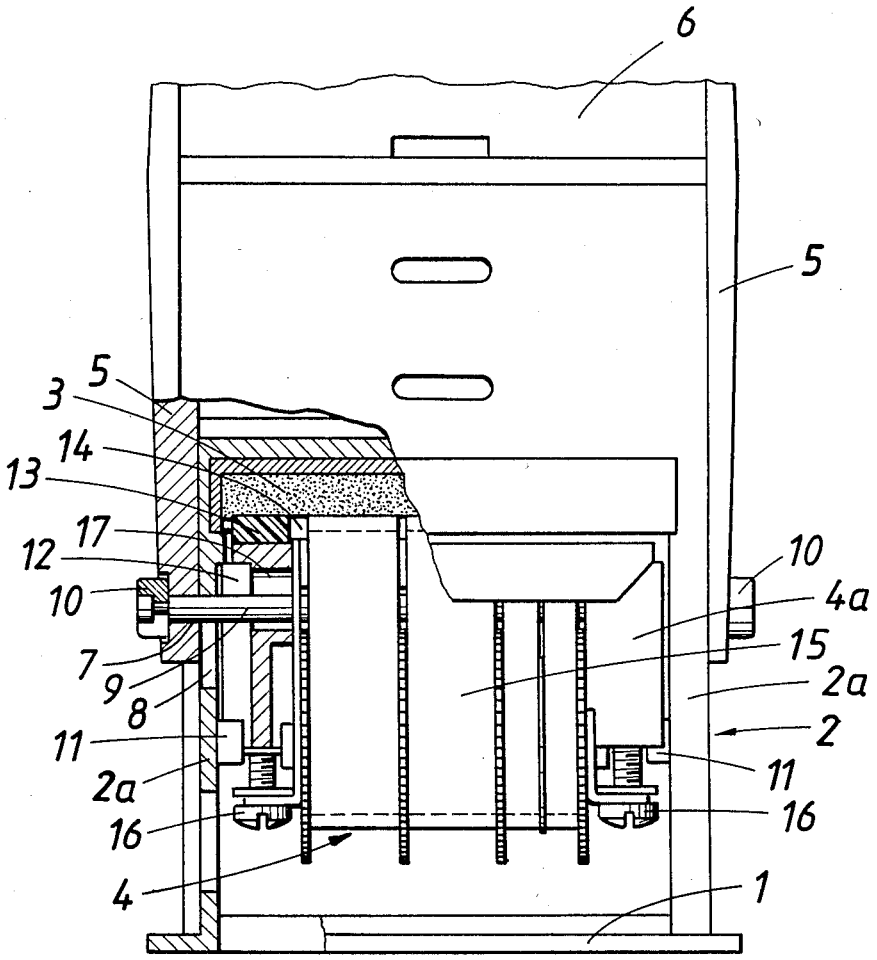
FIG. 1 is an elevation showing partly broken away a self-inking stamp for performing an inking upstroke.
Figure 2:
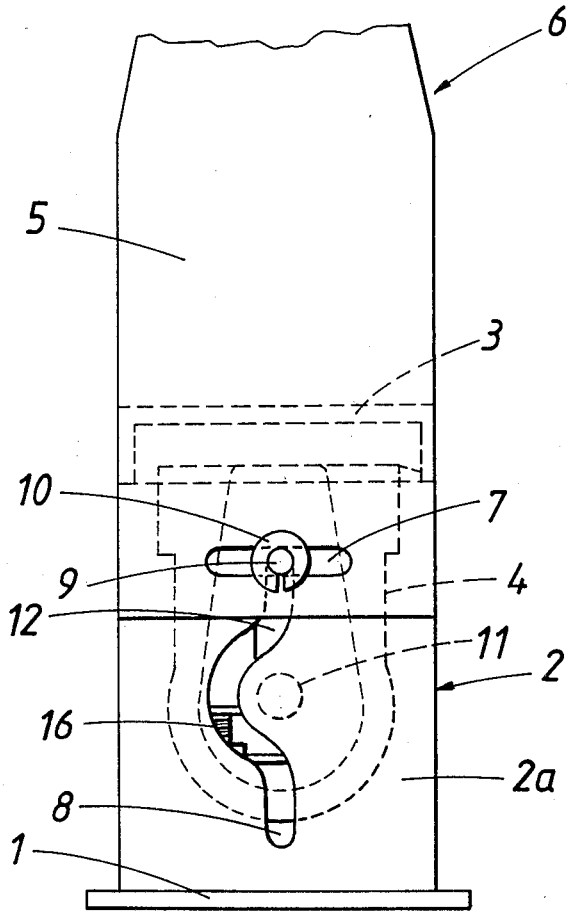
FIG. 2 is a corresponding side elevation.

An illustrative embodiment of the invention is shown on the drawing.

The self-inking stamping device comprises a base part 2, which accommodates an ink pad 3 and is provided with a bearing rim 1 for engaging the surface to be marked. The device also comprises a stamping insert 4, which is disposed in the base part 2 and adapted to be reciprocated between the ink pad and the bearing edge and to be inverted during its reciprocation. The stamping device also comprises a top part 6, which has two end legs 5, which are in sliding contact with opposite ends of the base part. Said top part is displaceable toward the bearing rim 1 against spring force. The top part 6 constitutes an actuating member, which in its end legs 5 is formed with slots 7, which extend transversely to the direction in which the actuating member 6 is displaceable. The end walls 2*a* of the base part 2 are formed with cam slots 8. The stamping insert 4 comprises a pivot 9, which extends through the cam slots 8 and the slots 7 and which at its ends carries retaining discs 10. Also for the control of the stamping insert 4, the end walls 2*a* of the base part are provided with inwardly protruding pins 11, which extend into vertical tracks 12 provided on the ends of the frame 4*a* of the stamping insert 4. All these features are known and need not be explained more in detail.

A printing plate 13 is preferably detachably secured to one side of a frame 4*a* of the stamping insert 4 and is formed with an aperture 14. A stamping belt unit 15 is also secured in the frame 4*a* and comprises a plurality of justaposed parallel endless stamping belts, which are longitudinally adjustable relative to each other and carry type protruding through the aperture 14.

The stamping belt unit can be adjusted by means of adjusting screws 16 in a direction which is normal to the plane of the printing plate so that the surface of the type on the printing plate and the surface of the type provided on the stamping belts can be adjusted to lie in one plane.

In accordance with the invention the pivot 9 of the entire stamping insert 4 is held without backlash in the stamping belt unit 15 and the pivot 9 extends through slots 17, which are formed in the frame 4*a* and extend in a direction which is normal to the plane of the printing plate. As a result, the pivot 9 is adjustable relative to the frame 4*a* along the slots 17 in unison with the stamping belt unit 15.

I claim:

1. In a self-inking stamping device for performing an inking upstroke, comprising a base part having a depending bearing rim for engaging a surface to be marked, and two mutually opposite end walls, each of which is formed with a cam slot and carries an inwardly protruding pin, a downwardly exposed ink pad secured to and extending in said base part above said bearing rim, a stamping insert disposed in said base part below said ink pad and having two mutually opposite ends facing respective ones of said end walls and provided each with a vertical track in sliding contact with one of said pins, said stamping insert also comprising a pivot extending through said cam slots, a frame pivoted on said pivot, a planar printing plate carried by said frame and formed with an aperture and provided on one side with plate type, a stamping belt unit, which is movably mounted in said frame and carries belt type facing in the same direction as said plate type and protruding through said aperture and screw means for adjusting said stamping belt unit relative to said frame in a direction which is normal to the plane of said printing plate, said stamping insert being movable between an upper position, in which said plate type and said belt type face upwardly and engage said ink pad, and a lower position, in which said plate type and said belt type face downwardly and are disposed adjacent to said bearing rim, and an actuating member, which has two legs in sliding contact with the outside surfaces of respective ones of said end walls and is vertically movable toward and away from said bearing rim and is formed in said legs with slots, which are transverse to the vertical direction and receive said pivot, wherein said slots in said legs, said pivot, said cam slots, said tracks and said pins are arranged to cooperate so as to move said stamping insert to said lower and upper positions, respectively, in response to a movement of said actuating member toward and away from said bearing rim, the improvement residing in that said frame is formed with slots extending normal to the plane of said printing plate and said pivot is held wihout backlash in said stamping belt unit and extends through said slots in said frame so that said pivot is adjustable relative to said frame along said slots therein in unison with said stamping belt unit.

2. The invention of claim 1 comprising spring means urging said actuating member away from said bearing rim.

3. The invention of claim 1 as in which said printing plate is detachably connected to said frame.

* * * * *